United States Patent [19]

Floroff

[11] 4,161,499

[45] Jul. 17, 1979

[54] FUEL METERING DEVICE FOR INTERNAL COMBUSTION ENGINE

[76] Inventor: Peter Floroff, 20 Nealon Ave., Toronto, Ontario, Canada, M4K 1Y9

[21] Appl. No.: 895,171

[22] Filed: Apr. 11, 1978

Related U.S. Application Data

[63] Continuation-in-part of Ser. No. 737,861, Nov. 2, 1976, abandoned.

[51] Int. Cl.[2] ..... F02M 7/10

[52] U.S. Cl. ..... 261/36 A; 123/139 AW; 137/563

[58] Field of Search ..... 261/36 A, 78 R; 123/139 AW; 137/563

[56] References Cited

U.S. PATENT DOCUMENTS

| | | | |
|---|---|---|---|
| Re. 27,087 | 3/1971 | Binder | 261/36 A |
| 2,136,959 | 11/1938 | Winfield | 261/36 A |
| 2,454,974 | 11/1948 | Mennesson | 261/36 A |
| 3,061,286 | 10/1962 | Mennesson | 261/36 A |
| 3,196,926 | 7/1965 | Gartland | 261/36 A |
| 3,235,237 | 2/1966 | Goetz et al. | 261/DIG. 19 |
| 3,313,532 | 4/1967 | Carlson et al. | 261/DIG. 19 |
| 3,327,760 | 6/1967 | Crawford, Jr. | 137/563 |

*Primary Examiner*—Tim R. Miles

*Attorney, Agent, or Firm*—Robert F. Delbridge; Arne I. Fors

[57] ABSTRACT

A fuel metering device for internal combustion engines is simple in structure, efficient in operation and capable of recirculating unused fuel. The device primarily comprises a plurality of passage elements interconnected to form the configuration of an inverted isosceles triangle having a median. The lower vertex of the triangle is connected to a fuel nozzle adjacent a venturi in an air supply passage of the engine, fuel is supplied under pressure from a pump to one upper corner of the triangle, and unused fuel is recirculated from the other upper corner to the fuel pump. The device operates in a manner equivalent to an electrical wheatstone bridge such that the fuel flow in the device tends to produce a balanced condition.

4 Claims, 1 Drawing Figure

FUEL METERING DEVICE FOR INTERNAL COMBUSTION ENGINE

Figure 1:
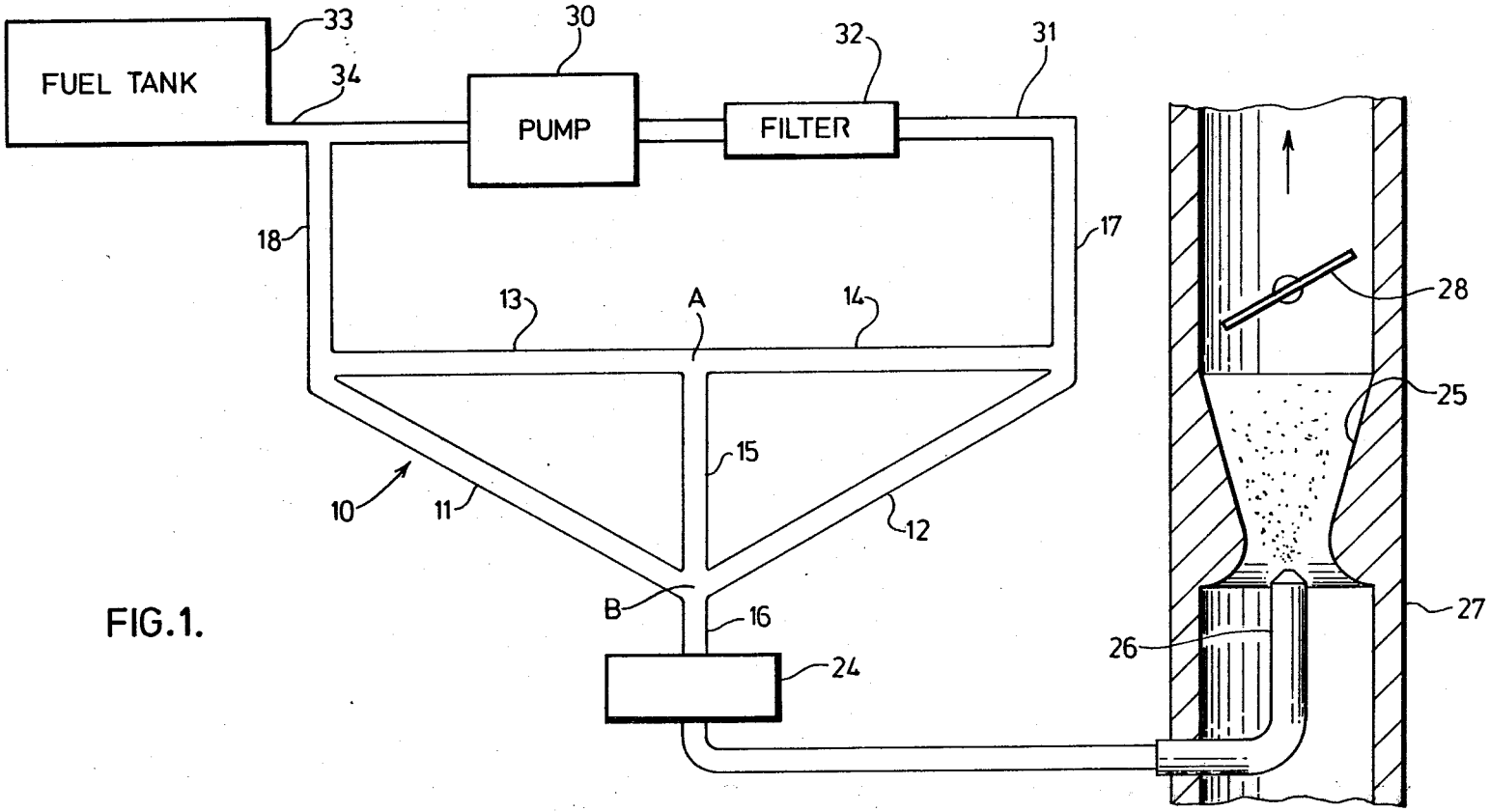

This application is a continuation in-part of application Ser. No. 737,861 filed Nov. 2, 1976 and now abandoned.

This invention relates to a fuel supply system for internal combustion engines.

Heretofore, carburetors have been used commonly for metering fuel to internal combustion engines. The main function of a carburetor is to provide an appropriate amount of air-fuel mixture to the engine under varying engine operating conditions. Known carburetors are complex in structure and have a large number of mechanical moving parts which are subject to wear and require constant adjustments and repair in order to maintain them functioning properly. Due to the complexity of the carburetor, adjustments and repair of its parts are time consuming and ofter difficult to carry out.

Furthermore, carburetors are inefficient in operation due to the existence of incomplete atomization of the fuel at the nozzle and their relatively slow response to engine demand. Complex mechanical means such as pressure pumps and power valves have been incorporated in carburetors to obviate such drawbacks. However, these additional means in turn further increase the complexity of the carburetor. Also, wastage of fuel often is present in known carburetors particularly due to the inefficiency of operation. The inefficient operation of carburetors contributes to the ineffective operation of internal combustion engines which produce unburned hydrocarbons and carbon monoxide that are emitted to pollute the atmosphere.

It is an object of the present invention to provide an efficient fuel metering means for internal combustion engines.

Another object of the invention is to provide a fuel metering means which is simple in structure and has relatively few moving parts for its operation.

According to the invention, a fuel metering system comprises a plurality of fuel passage elements forming a configuration which is mechanically equivalent to an electrical wheatstone bridge circuit. The fuel flow tends to maintain a balanced condition such that any unused fuel is automatically recirculated to the fuel pump. The balanced condition is altered by the pressure in the venturi of an air supply passage such that a suitable amount of fuel is discharged from the system to provide the required air-fuel mixture for the engine.

A preferred embodiment of the invention will now be described, with reference to the accompanying drawing in which:

FIG. 1 is a schematic diagram of a fuel supply system.

With reference to the drawing, a fuel metering means 10 comprises five passage elements 11, 12, 13, 14 and 15 forming generally the configuration of an inverted isosceles triangle having a median. Passage elements 11 and 12 form the two sloping bottom sides of the triangle, and passage elements 13, 14 and 15 form the two horizontal top sides and the vertical median of the triangle respectively. An extension passage element 16 is provided at the lower vertex of the triangle and extends downwardly therefrom. An input conduit 17 is connected to one corner of the triangle which is the junction between passage elements 12 and 14, and an output conduit 18 is connected to the other corner of the triangle which is the junction between passage elements 11 and 13.

The triangular configuration 10 formed by the passage elements 11, 12, 13, 14 and 15 is a mechanical equivalent of an electrical wheatstone bridge in that, when fuel passes through the configuration from the input conduit 17 to the output conduit 18, a balanced condition occurs in which the ratio of the amount of fuel flow in passage elements 12 and 14 is directly proportional to the ratio of the amount of fuel flow in passage elements 11 and 13. Under such balanced condition, the pressure at junction A of passage elements 13, 14 and 15 is equal to the pressure at junction B of passage elements 11, 12 and 15.

If the balanced condition is disturbed by creating a pressure gradient between junction A and junction B, a portion of the fuel flow will be directed from the higher pressure junction to the lower pressure junction to compensate for the pressure gradient until the liquid flow again returns to the balanced condition. The triangular configuration 10 is hereinafter referred to as "mechanical wheatstone bridge".

An electrically controlled valve 24 is provided in the extension passage element 16. The valve 24 is operated by the ignition switch for the engine such that the valve 24 is open when the ignition switch is turned on and the valve 24 is closed when the ignition switch is turned off.

The other end of the passage element 16 is connected to a fuel nozzle 26 adjacent a venturi 25 in the air supply passage 27 of the engine upstream of a conventional throttle 28. It will be understood that a conventional choke may be provided upstream of the venturi 25, and that a conventional idle jet may be provided adjacent the throttle 28 to enable the engine to idle when the throttle 28 is closed.

Fuel is supplied to the metering system by a fuel pump 30 connected to the input conduit 17 by connection conduit 31. A fuel filter 32 may be provided between the fuel pump 30 and the metering system 10 to prevent any contaminating particles which may be present in the fuel from entering the metering system. The fuel pump may operate in known manner by mechanical coupling to the engine crank shaft, or may be electrically driven.

The fuel pump 30 draws the fuel from a fuel tank 33 through a supply conduit 34, and the output conduit 18 of the metering system 10 is connected to the supply conduit 34 for recirculating fuel from passage elements 11 and 13 of the mechanical wheatstone bridge back to the fuel pump 30.

The metering system 10 according to the present invention may be constructed by tubular elements connected together to form the triangular configuration. Alternatively, it may be constructed by forming a channel or depression pattern having such triangular configuration on a planar surface of a rectangular block body, and the surface of the block body is covered by a removable cover member so as to form passages in the block body having such triangular configuration with the input conduit, output conduit and extension passage element attached thereto. Transparent heat-resistant plastics material may be used for making the block body such that the condition of the metering system is visible. It can be appreciated that the latter structure may be fabricated easily and quickly by using a mass production plastics injection moulding process.

The ignition switch is operated to actuate the electrical components of the engine and to rotate the starting motor. Also, the control valve 24 is opened. The rotation of the engine creates the initial vacuum condition in the venturi 25 and operates the fuel pump to cause the fuel to commence circulating in the mechanical wheatstone bridge. The vacuum or suction created in the venturi causes the pressure at junction B to drop proportionally. Thus, a pressure gradient is created between junction A and junction B which causes a corresponding amount of fuel to flow from junction A to junction B and be discharged from the nozzle 26 with the resultant air/fuel mixture passing into the engine in the usual manner.

Such fuel flow will thus compensate the pressure differential between junction A and junction B to return the mechanical wheatstone bridge 10 to a balanced condition, and the remaining unused fuel will continue to flow through passage elements 11 and 13 to the outlet conduit 18 to be recirculated to the fuel pump 30. Only the required amount of fuel is delivered to the engine by the device.

Due to the elimination of the float chamber and the provision of automatic recirculation of unused fuel in the system, there is little fuel wastage in the device compared with known carburetors. Also, due to its simple structure, relatively no adjustment is required to maintain the proper function of the device.

While the invention has been particularly shown and described with reference to a preferred embodiment thereof, it will be understood by those skilled in the art that various changes in form and detail may be made therein without departing from the spirit and scope of the invention.

What I claim as new and desire to protect by Letters Patent of the United States is:

1. A fuel metering device for an internal combustion engine comprising a fuel flow regulating means having a plurality of tubular passage elements forming a configuration of a generally isosceles triangle including a median, said triangle having a first side, and second and third sides extending from opposite ends of said first side to a vertex, and said median extending from the mid-point of said first side to said vertex, an input conduit connected to the junction of said first and second sides for supplying fuel under pressure to said regulating means, an output conduit connected to the junction of said first and third sides, and an extension passage element connected to said vertex, said extension passage element being connectible to a fuel nozzle adjacent a venturi in an air supply passage of an internal combustion engine whereby said regulating means is responsive to air pressure in the venturi to provide required fuel flow to said air supply passage.

2. A fuel metering device according to claim 1 wherein said input conduit is connected to a fuel pump operative to draw fuel from a fuel supply tank and deliver said fuel under pressure to said input conduit, and said output conduit is connected to said fuel pump for recirculating unused fuel from said output conduit to said fuel pump.

3. A fuel metering device for an internal combustion engine comprising a fuel flow regulating means having a plurality of tubular passage elements forming a configuration of an inverted generally isosceles triangle including a median, said triangle having a substantially horizontal upper side, two sloping sides joining said upper side at two upper corners and joining each other at a lower vertex, an input conduit connected to one upper corner of said triangle for supplying fuel under pressure to said regulating means, an output conduit connected to the other upper corner of said triangle, and an extension passage element connected to said lower vertex, said extension passage element being connectible to a fuel nozzle adjacent a venturi in an air supply passage of an internal combustion engine whereby said regulating means is responsive to air pressure in the venturi to provide required fuel flow to said air supply passage.

4. A fuel metering device according to claim 3 wherein said input conduit is connected to a fuel pump operative to draw fuel from a fuel supply tank and deliver said fuel under pressure to said input conduit, and said output conduit is connected to said fuel pump for recirculating unused fuel from said output conduit to said fuel pump.

* * * * *